US009926152B1

(12) United States Patent
Iguchi

(10) Patent No.: US 9,926,152 B1
(45) Date of Patent: Mar. 27, 2018

(54) IMAGE FORMING APPARATUS HAVING SHEET SORTING FUNCTION AND A SHEET SORTING METHOD

(71) Applicants: KABUSHIKI KAISHA TOSHIBA, Tokyo (JP); TOSHIBA TEC KABUSHIKI KAISHA, Tokyo (JP)

(72) Inventor: Ken Iguchi, Numazu Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/276,482

(22) Filed: Sep. 26, 2016

(51) Int. Cl.

| | |
|---|---|
| ***B65H 29/62*** | (2006.01) |
| ***B65H 29/60*** | (2006.01) |
| ***B65H 31/24*** | (2006.01) |
| ***B65H 7/02*** | (2006.01) |
| ***G03G 15/00*** | (2006.01) |
| ***B41M 7/00*** | (2006.01) |

(52) U.S. Cl.
CPC ..... *B65H 7/02* (2013.01); *B41M 7/0009* (2013.01); *B65H 29/60* (2013.01); *B65H 29/62* (2013.01); *B65H 31/24* (2013.01); *G03G 15/6529* (2013.01); *B65H 2511/411* (2013.01); *B65H 2511/512* (2013.01); *B65H 2551/18* (2013.01)

(58) Field of Classification Search
CPC ..... B65H 31/24; B65H 29/62; B65H 29/60; B41M 7/0009; B41J 2/32
See application file for complete search history.

(56) References Cited

U.S. PATENT DOCUMENTS

| | | | | |
|---|---|---|---|---|
| 6,285,844 | B1 | 9/2001 | Kuga | |
| 6,373,575 | B1 * | 4/2002 | Takayama | G01N 21/55 355/30 |
| 8,538,280 | B2 | 9/2013 | Yahata et al. | |
| 8,717,618 | B2 | 5/2014 | Iguchi et al. | |
| 8,899,705 | B2 * | 12/2014 | Iguchi | H04N 1/00567 347/1 |
| 9,205,668 | B2 * | 12/2015 | Morizumi | B41J 2/32 |

OTHER PUBLICATIONS

U.S. Appl. No. 14/749,451, filed Jun. 24, 2015.

* cited by examiner

*Primary Examiner* — Luis A Gonzalez
(74) *Attorney, Agent, or Firm* — Patterson & Sheridan, LLP

(57) ABSTRACT

An image forming apparatus includes first and second sheet storages, a sheet conveyer, an image reading unit configured to read a surface of a sheet conveyed from the first sheet storage by the sheet conveyer, an image forming unit configured to form an image on the sheet conveyed from the image reading unit, and a controller. The controller is configured to determine an amount of a color material appearing on the surface of the sheet based on image data generated by the image reading unit, determine one of the image forming unit and the second sheet storage as a sheet feeding destination, based on the determined amount of the color material and a threshold value that is associated with at least one of a type and content of an image to be formed on the sheet, and control the sheet conveyer to convey the sheet to the sheet feeding destination.

11 Claims, 10 Drawing Sheets

FIG. 5

| LEVEL | MAXIMUM CONCENTRATION (0~255) | AREA RATIO (0%~100%) |
|---|---|---|
| 1 | 120 OR HIGHER | 5.0% OR HIGHER |
| 2 | 90 OR HIGHER | 2.5% OR HIGHER |
| 3 | 80 OR HIGHER | 1.0% OR HIGHER |
| 4 | 60 OR HIGHER | 0.5% OR HIGHER |
| 5 | 50 OR HIGHER | 0.2% OR HIGHER |

FIG. 7

| USE PURPOSE/ IMAGE QUALITY | LEVEL |
|---|---|
| PERSONAL USE | 1 |
| EXTERNAL USE | 4 |
| COMMON MATERIAL | 2 |
| CONFIDENTIAL MATERIAL | 5 |
| MONOCHROME | 2 |
| COLOR | 3 |
| CHARACTER | 1 |
| PHOTOGRAPH | 4 |

IMAGE FORMING APPARATUS HAVING SHEET SORTING FUNCTION AND A SHEET SORTING METHOD

FIELD

Embodiments described herein relate generally to technology of erasing an image on a sheet and reusing the sheet.

BACKGROUND

There is a decoloring device that carries out a decoloring process on a sheet that has an image formed of a decolorable material, so that the sheet can be reused. However, even if the decoloring process is carried out, the image of the decolorable material may not be completely decolored, and the image may partially remain on the sheet. Such a sheet having an excessive amount of a remaining image may not be suitable for further use, i.e., non-reusable.

When sheets subjected to the decoloring process by the decoloring device are set in a sheet supply cassette of an image forming apparatus, the sheets may include non-reusable sheets, and thus the non-reusable sheets may be used for image forming. Although a use can manually sort out the sheets subjected to the decoloring process into reusable ones and non-reusable ones, it may take significant amount of time and also the sorting by the user may not be accurate.

DESCRIPTION OF THE DRAWINGS

FIG. 5 illustrates correspondence of maximum density and an area ratio with each level.

FIG. 7 illustrates correspondence between use purpose/image quality and a level.

DETAILED DESCRIPTION

Figure 1:
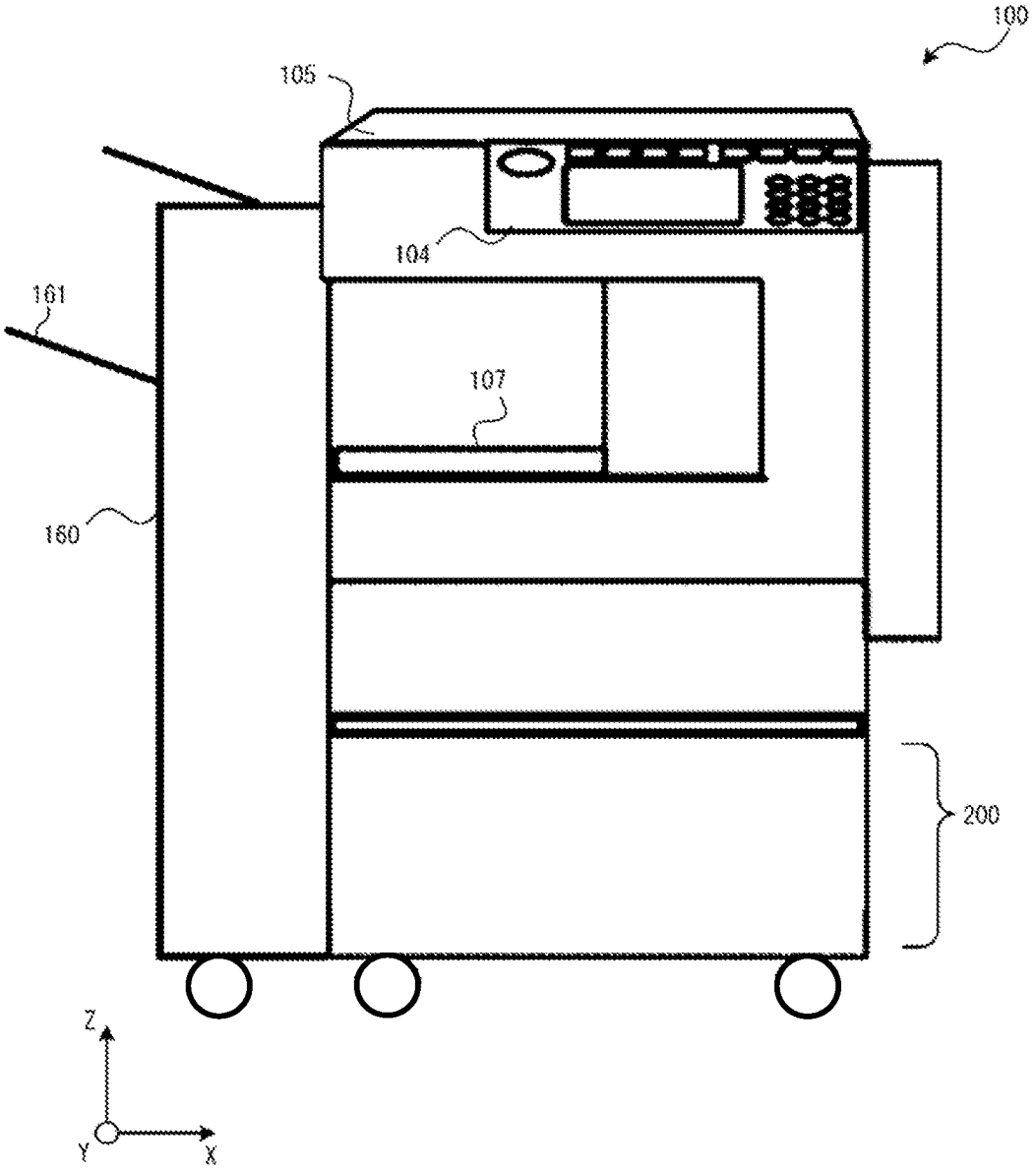
FIG. 1 is an external view of an image forming apparatus according to an embodiment.

An image forming apparatus includes first and second sheet storages, a sheet conveyer, an image reading unit configured to read a surface of a sheet conveyed from the first sheet storage by the sheet conveyer, an image forming unit configured to form an image on the sheet conveyed from the image reading unit, and a controller. The controller is configured to determine an amount of a color material appearing on the surface of the sheet based on image data generated by the image reading unit, determine one of the image forming unit and the second sheet storage as a sheet feeding destination, based on the determined amount of the color material and a threshold value that is associated with at least one of a type and content of an image to be formed on the sheet, and control the sheet conveyer to convey the sheet to the sheet feeding destination.

The image forming apparatus according to the embodiment includes a reading unit for determining reusability, in a unit that supplies a sheet subjected to a decoloring process. In the image forming apparatus of the embodiment, the reusability is determined before a copy process or a printing process is performed. In addition, in the image forming apparatus according to the embodiment, a sheet that is determined to be non-reusable is discharged to another discharge tray and an image forming process is continually performed using the next reusable sheet.

In addition, in the image forming apparatus according to the embodiment, it is possible to perform both of printing with a decolorable color material and printing with a non-decolorable color material. The decolorable color material is fixed on a sheet at a temperature equal to or higher than a prescribed fixing temperature and is decolored when heated to a temperature equal to or higher than a prescribed decoloring temperature that is or higher than the fixing temperature. The decolorable color material contains a coloring compound, a developer, and a decoloring agent. Examples of the coloring compound include a leuco dye or the like. Examples of the developer include phenols or the like. The decoloring agent is compatible with the coloring compound when heated, and examples thereof include a substance that does not have affinity with the developer. The decolorable color material produces a color due to interaction between the coloring compound and the developer. Since the interaction between the coloring compound and the developer is cut off when the decolorable color material is heated to a temperature equal to or higher than the decoloring temperature, decoloring is performed.

Note that, in the embodiment, toner is described as an example of a color material; however, an aspect of the embodiment is also applicable to other color materials such as ink. The "decoloring" in the embodiment means that an image formed with a color material (including not only a chromatic color, but also an achromatic color such as a white color, a black color, and the like), which is different from a base color of a sheet, becomes invisible. "become invisible" may be achieved by changing a color of an image formed on a sheet that is different from a base color of the sheet the same color as the base color of the sheet or by achromatizing (making transparent) the image.

Hereinafter, embodiments will be described with reference to the figures.

Figure 2:
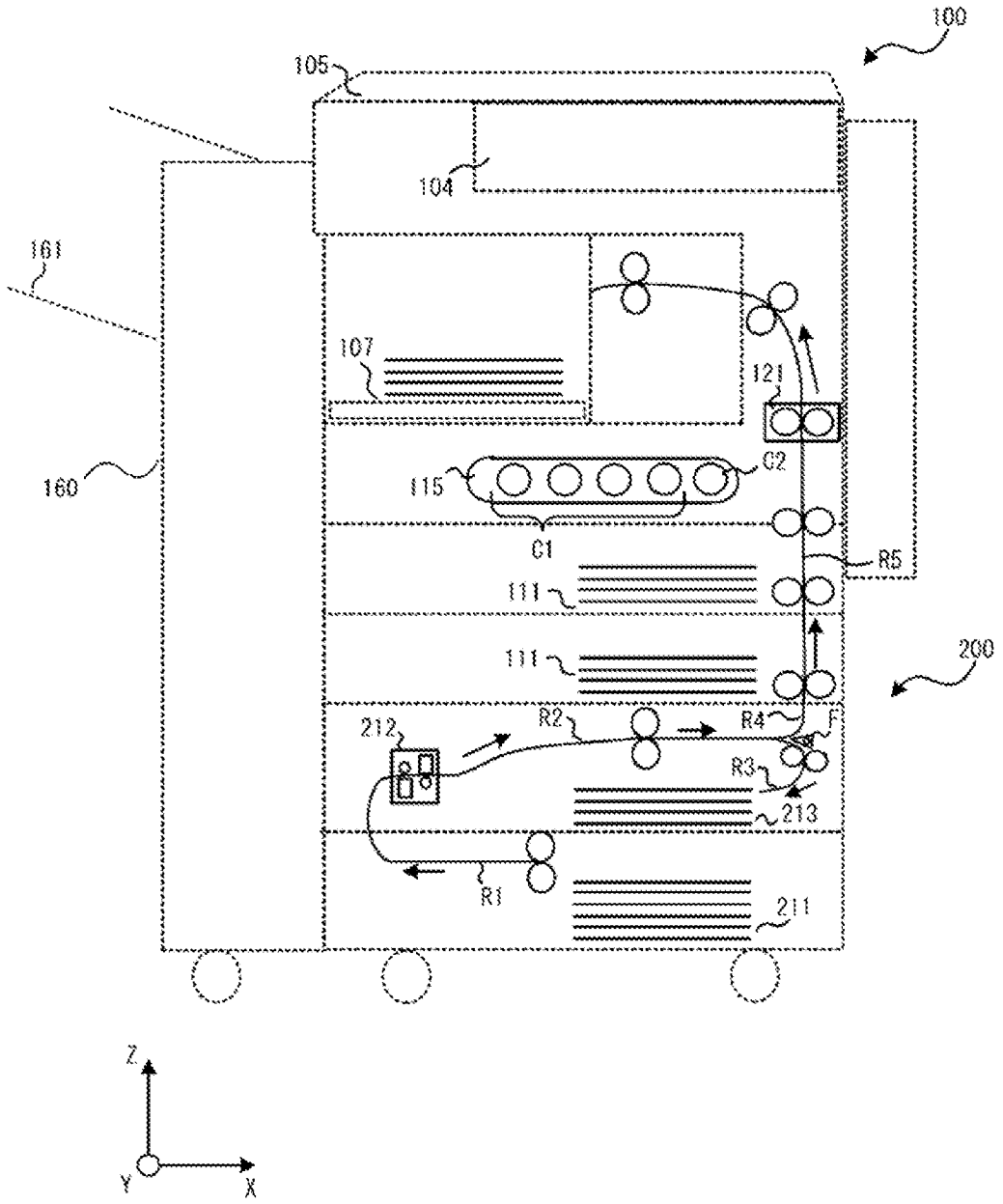
FIG. 2 schematically illustrates an internal configuration of the image forming apparatus according to the embodiment.

FIG. 1 illustrates an external appearance of an image forming apparatus of an embodiment. FIG. 2 schematically illustrates an internal configuration of the image forming apparatus. Here, an X axis, a Y axis, and a Z axis in the figures are common in the respective figures. In addition, arrows in FIG. 2 represent a convey direction of a sheet. Hereinafter, a configuration of an image forming apparatus 100 will be described with reference to FIG. 2.

The image forming apparatus 100 includes a common cassette 111 that is used to store a new sheet which has yet to be used. The image forming apparatus 100 includes an image forming unit 115 that forms an image on a sheet, and a discharge tray 107 on which sheets with formed images thereon are stacked. The image forming unit 115 includes cartridges C1 in each of which a non-decolorable color material is contained as a common color material, and a cartridge C2 in which a decolorable color material that is decolorable at a temperature equal to or higher than a prescribed decoloring temperature is contained. The cartridges C1 include cartridges of respective colors of cyan, magenta, yellow, and black. In addition, the image forming apparatus 100 includes a heater 121 that heats and pressurizes a sheet with a formed image thereon such that the image is fixed to the sheet.

The image forming apparatus 100 includes a convey route R5 through which a sheet is conveyed in order of the common cassette 111, the image forming unit 115, the heater 121, and the discharge tray 107. In addition, the image forming apparatus 100 includes an operating panel 104 that receives, from a user, an instruction of starting a process or an input of a parameter value such as the number of sets, and that displays a progress state of a job. The image forming apparatus 100 includes a scan unit 105 that reads an image on each sheet of an original document which is arranged on a transparent glass plate. Image data generated by the scan unit 105 is output to the image forming unit 115, and the image forming unit 115 forms an image corresponding to the image data on a sheet (copying process).

The image forming apparatus 100 includes a sorting device 200 in a lower. The sorting device 200 includes a used sheet cassette 211 (first sheet storage), a reading unit 212, and a rejected sheet cassette 213 (second sheet storage).

The used sheet cassette 211 is used to store stacked sheets after being subjected to a decoloring process. The decoloring process includes a process of heating a sheet with an image formed thereon with a decolorable color material at a temperature equal to or higher than the prescribed decoloring temperature. When the decoloring process is performed multiple times, a toner image may remain on a sheet. In this example, it is assumed that a sheet, on which a toner image apparently remains, is also stored in the used sheet cassette 211.

In addition, a user may erroneously determine that a sheet has been subjected to the decoloring process, even though actually, no decoloring process has been performed on the sheet, and such a sheet may be contained in the used sheet cassette 211. In other words, the used sheet cassette 211 may contain any sheet that has or has not been subjected to the decoloring process.

The reading unit 212 includes a charge-coupled device (CCD) image sensor that reads through a surface of a sheet contained in the used sheet cassette 211. In addition, the reading unit 212 includes a light emitting device that emits light toward a surface of a sheet when reading is performed by the CCD. The reading unit 212 reads though both surfaces of a first surface and a second surface of a sheet that is conveyed through a convey route R1 from the used sheet cassette 211. Image data generated by the reading unit 212 is temporarily stored in a storage unit (data storage) 282 to be described below.

The rejected sheet cassette 213 is used to store a sheet which is determined to be non-reusable, based on the image data generated by the reading unit 212. The sheet subjected to a reading process by the reading unit 212 is conveyed to the vicinity of a flapper F through a convey route R2. The flapper F switches between routes such that a sheet that is conveyed to the convey route R2 is continuously conveyed to one of a convey route R3 toward the rejected sheet cassette 213 and a convey route R4 toward the image forming unit 115.

The sheets stored in the rejected sheet cassette 213 may be subjected to the decoloring process by the decoloring device or are discarded.

If the sorting device 200 is mounted in the image forming apparatus 100 as an option, the convey route R4 and the convey route R5 are connected to each other. As a result, a sheet (reusable sheet), which is stored in the used sheet cassette 211 and is determined to be usable as a reading determination result, is conveyed to the image forming unit 115 through the convey routes R4 and R5. The image forming unit 115 forms an image on the conveyed sheet, and then, the heater 121 fixes the formed image to the sheet. The sheet is continuously conveyed through the convey route R5 and discharged to the discharge tray 107. According to this configuration, in the image forming apparatus 100, not only a sheet is supplied from the common cassette 111 that stores a new sheet and an image is formed on the sheet, but also, it is possible to supply a sheet from the used sheet cassette 211 and to form an image through discriminating process. When a job is executed, a user designates one cassette from which the sheet is supplied and the job is executed. In the following description, it is assumed that sheets are mainly supplied from the used sheet cassette 211.

The image forming apparatus 100 includes a post-processing device 160 that can be mounted as an option. The post-processing device 160 aligns positions of the sheets that are conveyed from the convey route R5, and performs the post-processing such as stapling or a hole-forming process (punching process). A sheet subjected to post-processing is discharged to a tray 161.

Figure 3:
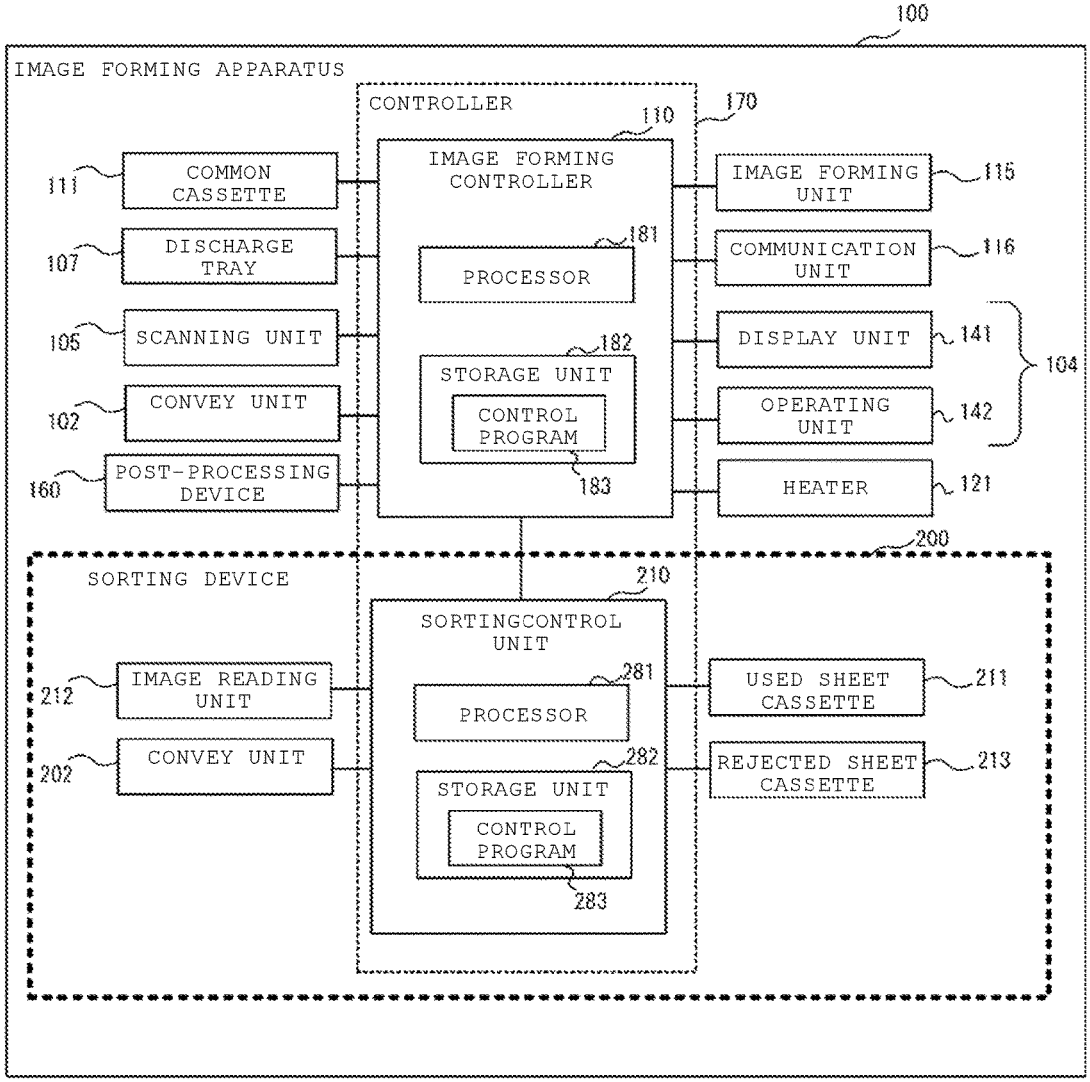
FIG. 3 is a block diagram of the image forming apparatus according to the embodiment.

FIG. 3 is a block diagram illustrating a configuration of the image forming apparatus 100 of the present embodiment. The image forming apparatus 100 includes an image forming control unit 110 that includes at least a processor 181 and a storage unit 182. The processor 181 is an arithmetic processing unit such as a central processing unit (CPU). The processor 181 executes a program stored in the storage unit 182 to perform various functions. The storage unit 182 includes a main storage device that stores data in a volatile manner, and performs input and output of data directly with the processor 181. In addition, the storage unit 182 includes a ROM and an auxiliary storage device, and stores a control program 183 or data in a non-volatile manner. The processor 181 computes and executes the control program 183, whereby the image forming control unit 110 collectively controls the image forming apparatus 100.

The image forming apparatus 100 includes a communication unit 116. The communication unit 116 receives print data from a personal computer or the like, based on an instruction of the image forming control unit 110. In addition, the communication unit 116 transmits a message related to a processing result or a status to a personal computer. The image forming apparatus 100 receives the print data, and then, forms an image corresponding to the print data on a sheet (printing process).

The common cassette 111, the discharge tray 107, the scan unit 105, the image forming unit 115, the heater 121, and the post-processing device 160 illustrated in FIG. 3 are described as described above. The operating panel 104 includes a display portion 141 as a flat liquid crystal monitor, and an operating unit 142 that includes a physical button and a touch panel arranged on the display portion 141. The convey unit 102 forms the convey route R5 and conveys a sheet to the respective units in response to an instruction from the image forming control unit 110.

The sorting device 200 includes a sorting control unit 210. The sorting control unit 210 collectively controls respective units of the sorting device 200 and includes a processor 281 and the storage unit 282. The processor 281 is an arithmetic processing unit such as the CPU. The processor 281 controls the respective units of the sorting device 200 according to data stored in the storage unit 282 and a code of a control program 283. Apart or the entirety of functions performed by the sorting control unit 210 may also be performed by a circuit such as an application specific integrated circuit (ASIC). Alternatively, the functions performed by the sorting control unit 210 may be performed by the image forming control unit 110 of the image forming apparatus 100.

The used sheet cassette 211, the rejected sheet cassette 213, and the reading unit 212 in FIG. 3 are the same as those described in FIGS. 1 and 2. The convey unit 202 forms the convey routes R1, R2, R3, and R4, includes rotation rollers and the flapper F, and conveys a sheet to the respective units in response to an instruction from the sorting control unit 210.

A controller 170 is configured with the image forming control unit 110 and the sorting control unit 210. In other words, the controller 170 collectively controls all of the units of the image forming apparatus 100 including the sorting device 200.

Figure 4:
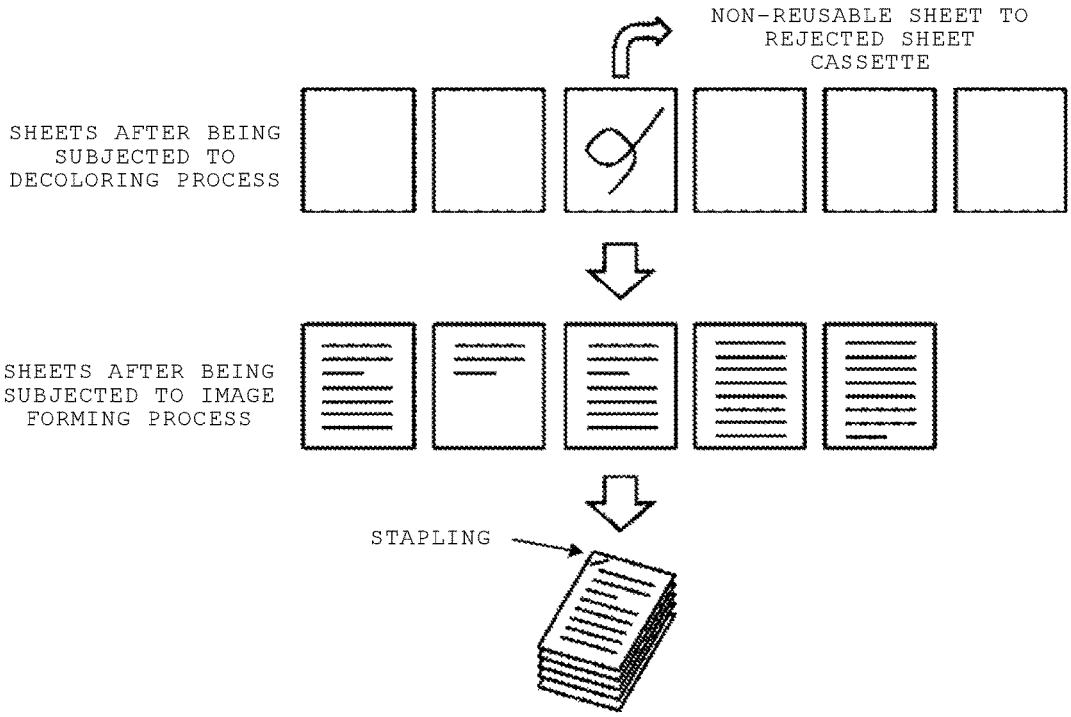
FIG. 4 schematically illustrates an operation of removing a non-reusable sheet.
Figure 10:
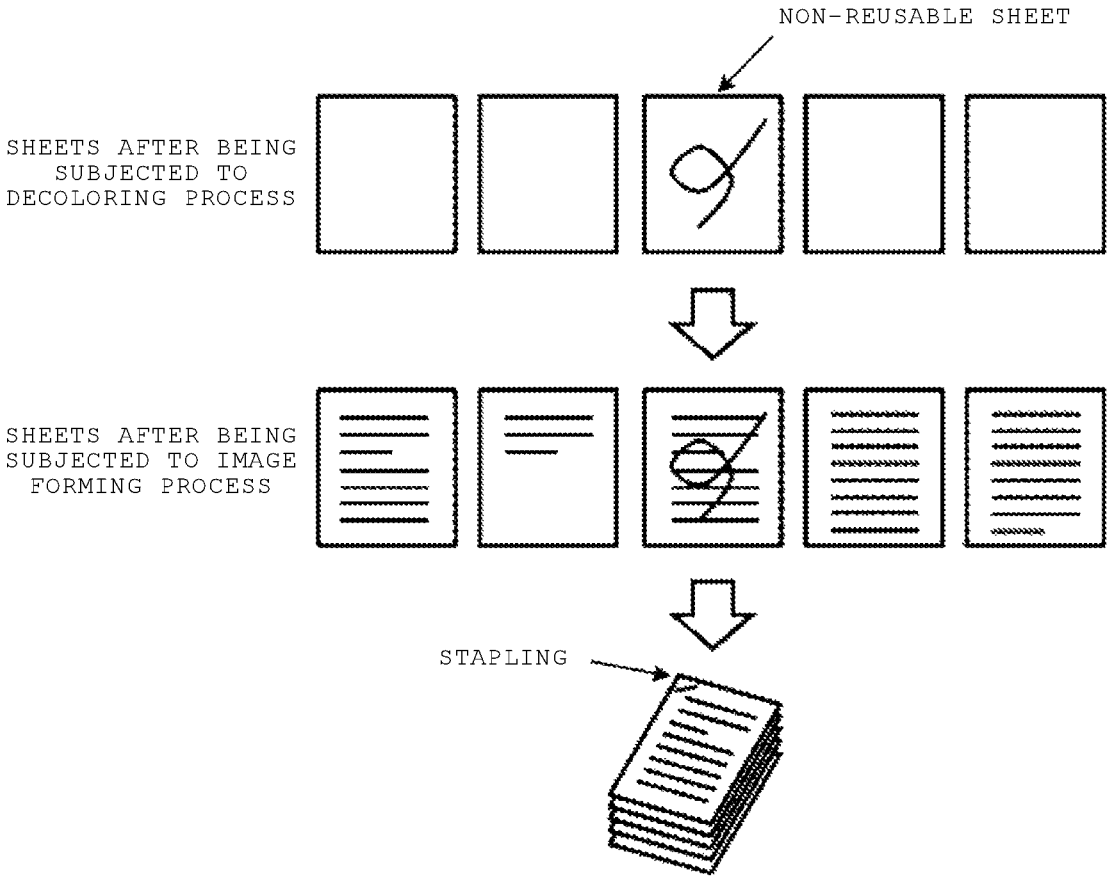
FIG. 10 depicts a sheet feeding that does not include the operation according to an embodiment.

FIG. 4 schematically depicts an operation of removing a non-reusable sheet. As depicted in FIG. 10, conventionally, even if a sheet determined not to be reusable is contained, the sheet would be used for image forming without being removed.

Specifically, if an image is formed using the cassette in which the reusable sheet and the non-reusable sheet are stacked together, as illustrated in FIG. 10, an image is formed even on the non-reusable sheet. If such non-reusable sheets are mixed together as a material, the sheets are not suitable for use. To the contrary, according to the embodiment, a sorting process is performed each time a sheet is supplied from the used sheet cassette 211. As a result, it is possible to form images selectively on sheets that are determined to be reusable. Accordingly, the sheet with a formed image thereon, which is not suitable for use, is not used for image forming.

The sorting control unit 210 compares an amount of a color material remaining on a sheet and a threshold value stored in the storage unit 282 in advance, and determines reusability. The threshold value may be stored in the storage unit 182 in advance. Specifically, in the present embodiment, maximum density (color density) of toner remaining on the sheet, and an area ratio of an area on which density of toner remaining on the sheet is equal to or higher than a prescribed value to an entire surface area of the sheet are calculated as the amount of the color material. Then, and the maximum density and the area ratio are compared to a threshold value that is defined in advance. If one or both of the maximum density and the area ratio of the remaining toner is beyond a prescribed permissible range of the threshold value, the sorting control unit 210 determines the sheet subjected to the process as a non-reusable sheet. The non-reusable sheet is conveyed to the rejected sheet cassette 213. By contrast, if both of the maximum density and the area ratio of the remaining toner is within the permissible range, the sorting control unit 210 determines the sheet subjected to the process as a reusable sheet. The reusable sheet is conveyed to the image forming unit 115.

In this example, reusability of sheets is determined based on the maximum density and the area ratio; however, this is described just as an example. Reusability may be determined based on an average density value of the remaining toner, a position of the remaining toner on a surface of the sheet, or the like.

In the present embodiment, according to a use purpose, or an image quality, which is determined based on content of images (for example, a document only formed of a character, a document containing a diagram, or a photograph), five sets of threshold values (sets of the threshold value of the maximum density and the area ratio) are prepared for five levels. FIG. 5 illustrates correspondence between the levels and the sets of the threshold values. When level 1 is set, if the maximum density of a read image is 120 or higher, or/and if the area ratio the read image is 5% or higher, the image forming apparatus 100 conveys the corresponding sheet to the rejected sheet cassette 213 and the sheet is removed. When level 5 is set, if the maximum density of a read image is 50 or higher, or/and if the area ratio of the read image is 0.2% or higher, the image forming apparatus 100 conveys the corresponding sheet to the rejected sheet cassette 213 and the sheet is removed. In this example, the higher the level is, the smaller the threshold values of the maximum density and the area ratio are. In other words, as the level becomes higher, the permissible range of reusability becomes narrower. As a result, the used sheet is more likely to be determined as non-reusable (i.e., an image is more likely to be formed on a sheet having a good quality on which an amount of remaining toner is smaller). The values illustrated in FIG. 5 are examples.

Figure 6:
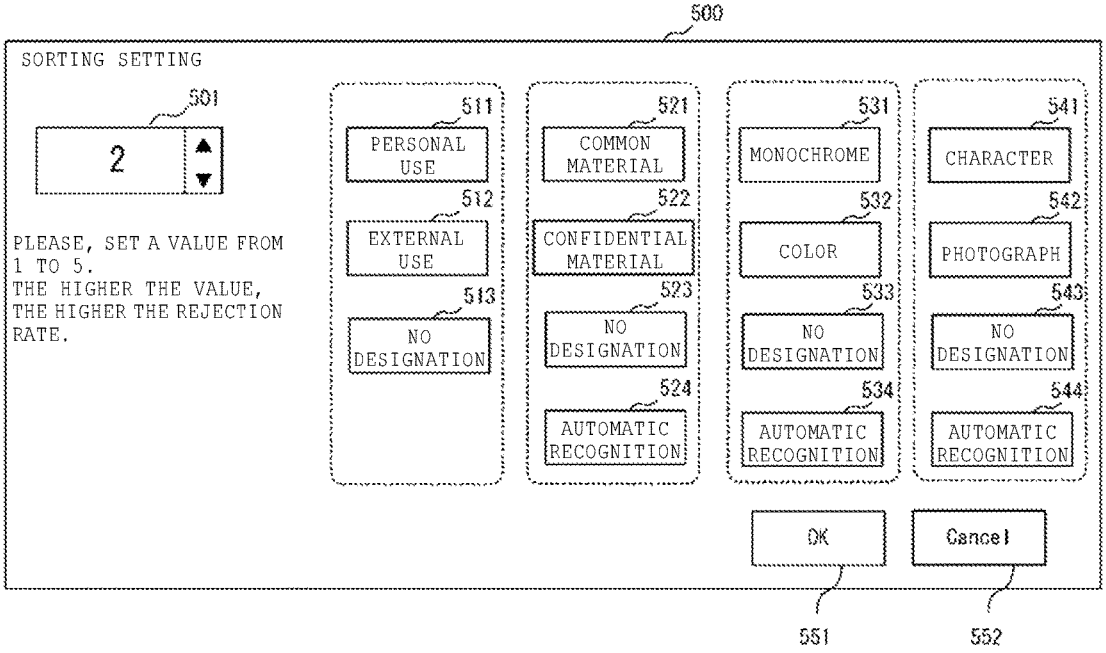
FIG. 6 illustrates an example of a sorting setting screen.

FIG. 6 illustrates an example of an operating screen on which a user designates the levels. The sorting setting screen 500 illustrated in FIG. 6 is displayed on the operating panel 104 when a job of image forming process such as a copying process or a printing process is executed. In addition, by the processor 281 executing the control program 283, the sorting setting screen 500 is displayed on the operating panel 104.

In this example, as described above, five sets of the threshold values of the maximum density and the area ratio for five levels are stored in the storage unit 282 in advance. When a user designates a value from one to five in a field 501, threshold values are set in the storage unit 282 according to the designated level. The value originally designated in the field 501 is a default value of the level.

The sorting setting screen 500 includes buttons for designating a use purpose or an image quality, in addition to the field 501 to designate the level. Correspondence between the use purpose or the image quality and the level will be described below.

The sorting setting screen 500 includes buttons 511 and 512 for designating, as the use purpose of the sheet obtained after an image is formed thereon, whether a material is for a personal use (or an internal use) or for an outside use (or an external use). In addition, the sorting setting screen 500 includes buttons 521 and 522 for designating whether the material is a common material (non-confidential material) or a confidential material. The sorting setting screen 500 includes buttons 531 and 532 for designating, as an image quality, monochrome (black and white) and color, respectively, and buttons 541 and 542 for designating a character mode and a photograph mode, respectively. In the present embodiment, by selecting non-designating buttons 513, 523, 533, and 543, it is possible not to designate a use or an image quality. If the non-designating button is selected, the process is performed according to the level corresponding to the value designated in the field 501.

On the sorting setting screen 500, buttons 524, 534, and 544 for automatic recognition are also arranged. In the present embodiment, the reusability is determined immediately before the image forming process and the sorting process are executed. For that reason, by selecting the buttons 524, 534, and 544 for automatic recognition, the sorting control unit 210 analyzes pages of original document data or printing data using a technique in the related art, and changes the level for each page based on content of the page and selects the threshold values corresponding to the level.

If the button 524 for the automatic recognition is selected, the sorting control unit 210 enters into a mode of determining whether the material to be produced is a non-confidential material or a confidential material. In the case of the copying process, the sorting control unit 210 determines whether or not a sheet of an original document includes characters of "for internal use only", "top secret", or the like, using OCR technology or the like. In addition, in the case of the printing process, the sorting control unit 210 determines whether or not printing data contains characters of "for internal use only", "top secret", or the like.

If the sheet of the original document or the printing data contains the characters "for internal use only", "top secret", or the like, the sorting control unit 210 executes a process of producing a confidential material. In other words, the sorting control unit 210 analyzes the sheet of the read original document, determines the document as the "confidential material", and sets the level or the set of the threshold values corresponding to the "confidential material". By comparison, if the sheet of the original document or the printing data does not contain the characters of "FOR INTERNAL USE ONLY", "top secret", or the like, the sorting control unit 210 sets the level or the set of the threshold values corresponding to the "common material".

If the button 534 for the automatic recognition is selected, the sorting control unit 210 enters into a mode of determining whether the monochrome printing is performed or the color printing is performed. In the case of the copying process, the sorting control unit 210 determines whether or not the sheet of the original document includes images for color printing. In addition, in the case of the printing process, the sorting control unit 210 determines whether the print data contains a value designating the color printing. The sorting control unit 210 sets a level or a set of the threshold values according to one of monochrome printing and color printing based on the determination result.

If the button 544 for the automatic recognition is selected, the sorting control unit 210 enters into a mode of determining whether the material is produced in a photographic mode or is produced in a text mode. In the case of the copying process, the sorting control unit 210 determines, for each page based on a printing rate, whether the sheet of the original document includes an image such as a photograph. In the case of the printing process, the sorting control unit 210 determines, for each page, whether the printing data contains image data such as a photograph. The sorting control unit 210 sets the level or the set of the threshold values corresponding to one of the photographic mode and the text mode that is determined through the above process.

The sorting control unit 210 determines the level, based on which button is selected, and selects one set of threshold values from the sets of the threshold values defined in advance. Here, the sorting control unit 210 performs exclusive control such that only one of the buttons is selectable within each of regions within the dashed line. For example, if the button 511 is selected and then the button 513 is selected, the sorting control unit 210 determines that the button 513 is in a selected state and the selected state of the button 511 is released.

FIG. 7 is a list illustrating correspondence between use purpose/image quality and a value of a level. The correspondence in FIG. 7 is stored in the storage unit 282 in advance. For example, if the button 512 for outside use is selected, the sorting control unit 210 sets level 4. In addition, if the button 532 for color is selected, the sorting control unit 210 sets level 3. In the present embodiment, the level of the highest value among levels corresponding to the selected use purpose/image quality is set as the final value of the level.

With reference to FIGS. 7 and 5, in the case of outside use, a threshold value, with which rejection is more likely to be performed than in the case of personal use, is selected. In other words, a user who selects the outside use can perform printing on a sheet having a good state which is less used. In addition, if the color printing is selected, a threshold value, with which rejection is more likely to be performed than in the case of monochrome printing, is selected. In addition, if the photograph is selected, a threshold value, with which rejection is more likely to be performed than in the case of character printing, is selected.

When the buttons illustrated in FIG. 6 are selected, and then a user pushes an OK button 521, the sorting control unit 210 stores setting values in the storage unit 282. Then, the main menu goes back on the screen while the corresponding setting values are held, or the image forming process is started using the corresponding setting value. When the user pushes a cancel button 522, the sorting control unit 210 discards the setting values.

Figure 8:
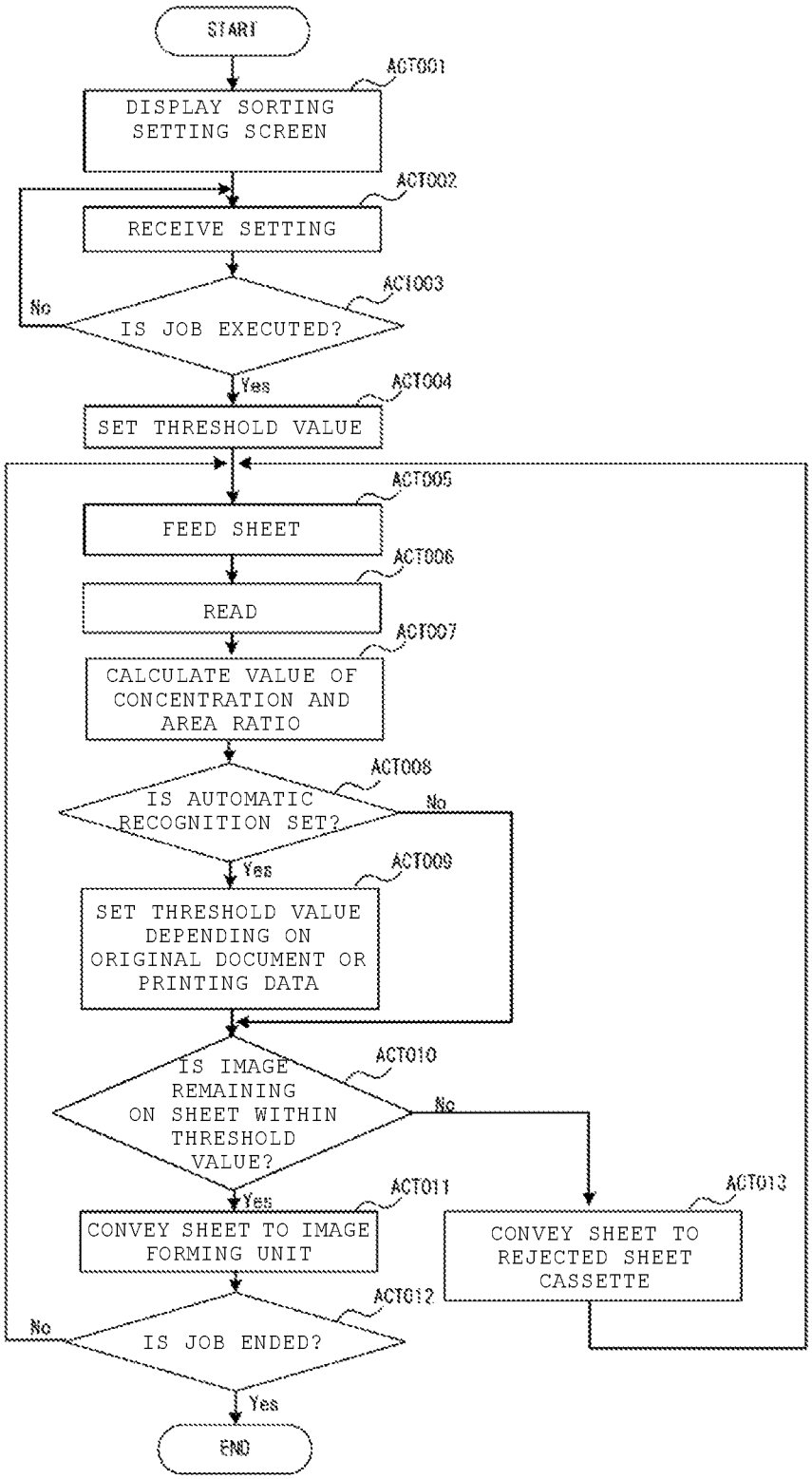
FIG. 8 is a flowchart illustrating a procedure of an operation according to the embodiment.

FIG. 8 is a flowchart illustrating a procedure of an operation carried out by the image forming apparatus 100. In the flowchart illustrated in FIG. 8, the processor 281 executes the control program 283 stored in the storage unit 282, operating in cooperation with various kinds of hardware. In other words, the sorting control unit 210 controls the operation. Alternatively, the image forming control unit 110 may control a part or the entirety of the operation. In other words, the controller 170 controls the operation illustrated in FIG. 8. Here, the copying process is described; however, it is possible to apply the operation to another job (printing process).

The sorting control unit 210 controls the operating panel 104 to display the sorting setting screen 500 illustrated in FIG. 6 (ACT001). After login of a user is authenticated, or when a button for prescription on the main menu is selected, the sorting control unit 210 displays the sorting setting screen 500. The sorting control unit 210 receives the setting value from the user through the operating unit 142 (ACT002). Here, the reception means that the input value or the value according to the button is temporarily stored in the storage unit 282.

The sorting control unit 210 determines whether or not a job is to be executed (ACT003). Here, the sorting control unit 210 determines whether the OK button 521 is selected. Alternatively, the sorting control 210 unit may determine whether or not a start button on the main menu is selected.

When the OK button 521 is selected (ACT003—Yes), the sorting control unit 210 sets the level based on the correspondence in FIG. 7 and acquires the threshold values corresponding to the set level, by referring to the correspondence in FIG. 5 (ACT004). Here, if there are a plurality of levels corresponding to the setting, the sorting control unit 210 selects the highest value of the levels, that is, threshold values (threshold values with which the best printed material is obtained) having the narrowest range.

The sorting control unit 210 controls so as to pick up one sheet in the used sheet cassette 211, and controls a roller pair or the like on the convey route R1 such that the picked-up sheet is conveyed to the reading unit 212 (ACT005).

The sorting control unit 210 controls the reading unit 212 to read surfaces of the conveyed sheet (ACT006). The reading unit 212 reads both surfaces of a first surface and a second surface of the sheet. Image data obtained through this reading operation is temporarily stored in the storage unit 282.

The sorting control unit 210 scans the obtained image data in a unit of pixel, and calculates the maximum value of density of the remaining toner in the image (ACT007). In addition, the sorting control unit 210 calculates a ratio of an area (area ratio) of an area of a toner region having a density equal to or higher than a certain value to the entire sheet area (ACT007).

The sorting control unit 210 determines whether the automatic recognition is set (ACT008). If the automatic recognition is set, the sorting control unit 210 sets the threshold values corresponding to properties of the sheet of the original document (ACT009). The sorting control unit 210 sets the threshold values (threshold values with which printed material having a better quality is produced) with which a rejection rate is more increased, between the level obtained in ACT004 and the level obtained in ACT009.

A specific example of ACT009 is described below. Here, it is assumed that the highest level set in ACT004 is 3, and that the button 524 for automatic recognition between the common material and the confidential material is selected. If the sheet of the original document as the source of the copy has the characters such as "for internal use only", the result of the automatic recognition is set as level 5. In this case, the sorting control unit 210 employs the threshold values of level 5 so as to increase the rejection rate. If level 3 is set in ACT004, the character such as "for internal use only" is not found in ACT009, which amounts to level 2 as the common material, level 3 as a higher level is maintained.

The sorting control unit 210 compares the highest values of density and the area ratio of the used sheet, which are obtained in ACT007, with the threshold values (threshold value of the highest value of density and threshold value of the area ratio) corresponding to the level set in or before ACT009 (ACT010). If the used sheet has values within the threshold values (ACT010—Yes), the sorting control unit 210 controls the flapper F such that the used sheet is guided to the convey route R4. As a result, the corresponding sheet is subjected to the image forming (ACT011). The sorting control unit 210 determines whether or not the image forming of the corresponding job is completed for all pages (ACT012). If it is determined that the image forming is completed (ACT012—Yes), the process is ended. If it is determined that there is a page on which the process has not been performed (ACT012—No), the process returns to ACT005.

ACT010 is descried in detail. If the used sheet does not have the values within the threshold values (ACT010—No), the sorting control unit 210 controls the flapper F such that the used sheet is guided to the convey route R3 and then to the rejected sheet cassette 213 (ACT013). When the used sheet is rejected, the printing page in the current process is printed on a next non-rejected sheet (a loop from ACT013 to ACT005).

Figure 9:
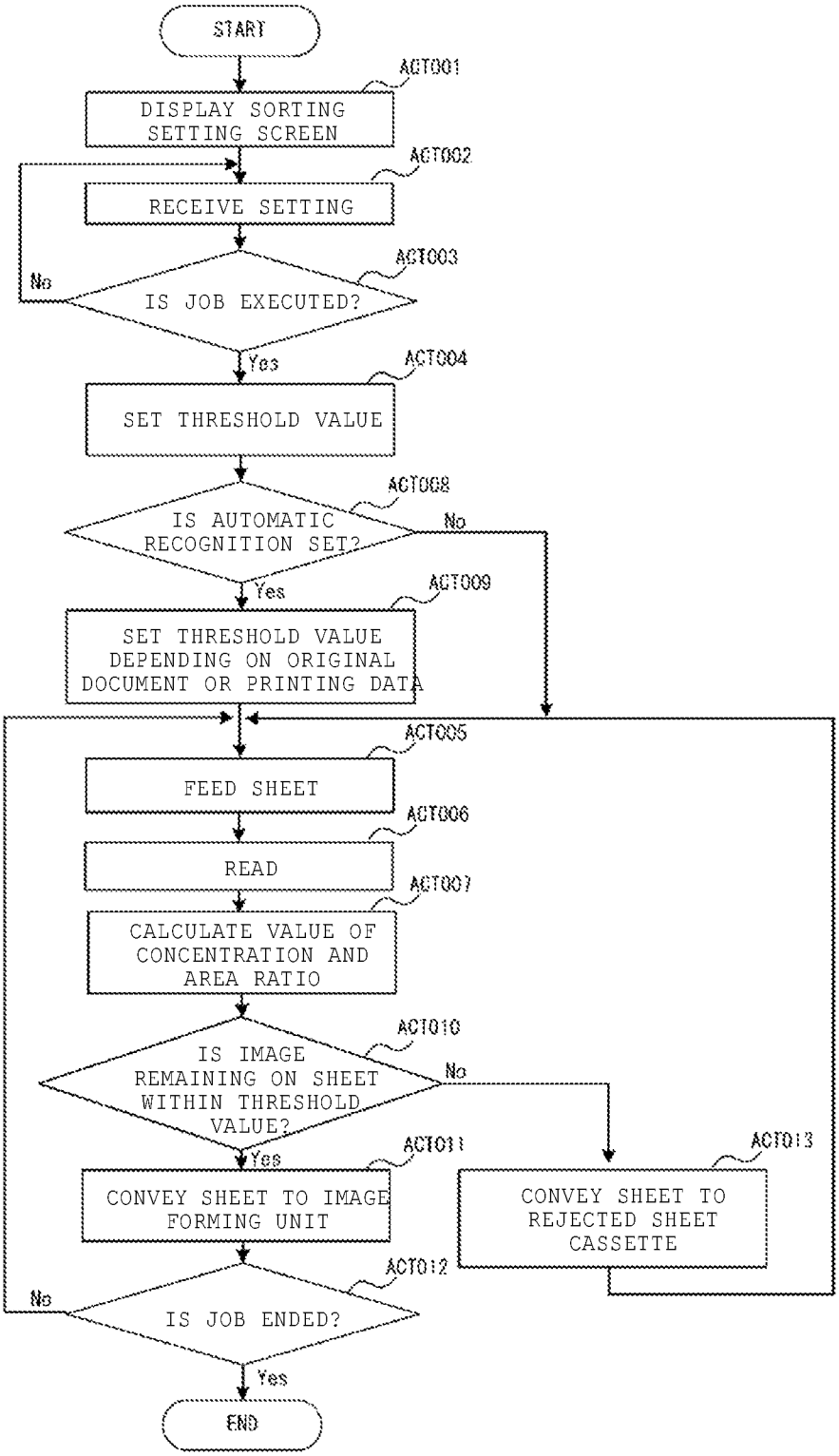
FIG. 9 is a flowchart illustrating a procedure of an operation according to another embodiment.

If the automatic recognition is set, in an example in FIG. 8, since a recognizing process is performed on the sheet of the original document page by page, the threshold value can be changed for each page. However, if a material containing, for example, a page including a photograph and a page including a character is copied, the threshold values of the page containing the photograph is different from the threshold values of the page containing the character. Similarly, a material containing a color page and a monochrome page has threshold values different from each other. If the different threshold values are set among pages, a printed sheet bundle may include a page with non-decolored toner significantly remaining thereon and a page with non-decolored toner less significantly remaining thereon. To perform printing on sheets of more uniform quality, as illustrated in FIG. 9, a part of an operational order in FIG. 8 may be changed. In other words, ACT008 and ACT009 shown in FIG. 8 are performed between ACT004 and ACT005 (refer to FIG. 9). In addition, in ACT009, all of the pages in the data of the original document are obtained collectively, analysis is performed for each page so as to calculate the level for each page, and the highest level is employed. From ACT005 to the end, a sheet, which is supplied from the used sheet cassette 211, is determined, using the set of the threshold values corresponding to the highest level determined in ACT009. As a result, it is possible to use the same threshold value for pages of the same material, and it is possible to print images on sheet of more uniform quality.

In the embodiment described above, reusability of a sheet is determined, based on the threshold values, which are defined in advance corresponding to the content of an image to be formed on the sheet, and the amount of the color material calculated from the image data generated by the reading unit 212.

Hereinafter, a modification example of the embodiment is described. As the modification example, if a marking indicating how many times the decoloring process is performed on a sheet is printed, it is possible to determine the reusability by comparing a threshold value, which is defined in advance corresponding to the content of an image to be formed on the sheet, with the number of markings read by the reading unit. In this case, the storage unit 282 stores a determination criterion defined in advance such that as the level becomes higher, the threshold value corresponding to the number of markings that indicates how many times the decoloring process has been performed becomes larger. For example, if the level is 1, the number of times of the decoloring process is set as five times, as the threshold value. If the value of the level is 2, the number of times of the decoloring process is set as three times, as the threshold value. If the value of the level is 3, the number of times of the decoloring process is set as once, as the threshold value. In other words, in the corresponding determination criterion, as the level becomes higher, the permissible range of the reusability becomes narrower, and the rejection is more likely to be performed. The determination criterion is applied to the flowchart illustrated in FIGS. 8 and 9, thereby, making it possible to perform the image forming on a sheet suitable for printing content.

As specifically described above, according to technology described in the disclosure, even when a sheet including an image that cannot be decolored through the decoloring process is defectively performed and a sheet including an image that has not subjected to the decoloring process is contained in sheets used for image forming, it is possible to remove such sheets, and it is possible to perform an operation by reducing waste toner formed on the undesirable sheets. While certain embodiments have been described, these embodiments have been presented by way of example only, and are not intended to limit the scope of the inventions. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a first sheet storage;

a second sheet storage;

a sheet conveyer;

an image reading unit configured to read a surface of a sheet conveyed from the first sheet storage by the sheet conveyer;

an image forming unit configured to form an image on the sheet conveyed from the image reading unit by the sheet conveyer; and a controller configured to set at least one of a type and a content of an image to be formed on the sheet by analyzing print data for the image to be formed, wherein the content of the image is set as one of a text image and a picture image, determine an amount of a color material appearing on the surface of the sheet based on image data generated by the image reading unit, compare the determined amount of the color material and a threshold value, and determine the image forming unit as a sheet feeding destination when the determined amount of the color material is less than the threshold value, and the second sheet storage as the sheet feeding destination when the determined amount is greater than the threshold value, wherein the threshold value is associated with at least one of a type and content of an image to be formed on the sheet, and a threshold value associated with the text image is less than a threshold value associated with the picture image, and control the sheet conveyer to convey the sheet to the determined sheet feeding destination.

2. The apparatus according to claim 1, wherein the controller is configured to set at least one of the type and the content of the image to be formed for each page, when the print data include data for multiple pages.

3. An image forming apparatus, comprising:

a first sheet storage;

a second sheet storage;

a sheet conveyer;

an image reading unit configured to read a surface of a sheet conveyed from the first sheet storage by the sheet conveyer;

an image forming unit configured to form an image on the sheet conveyed from the image reading unit by the sheet conveyer; and a controller configured to set at least one of a type and a content of an image to be formed on the sheet by analyzing print data for the image to be formed, wherein the type of the image is set as one of a confidential image and a non-confidential image, determine an amount of a color material appearing on the surface of the sheet based on image data generated by the image reading unit, compare the determined amount of the color material and a threshold value, and determine the image forming unit as a sheet feeding destination when the determined amount of the color material is less than the threshold value, and the second sheet storage as the sheet feeding destination when the determined amount is greater than the threshold value, wherein the threshold value is associated with at least one of a type and content of an image to be formed on the sheet, and a threshold value associated with the confidential image is greater than a threshold value associated with the non-confidential image, and control the sheet conveyer to convey the sheet to the determined sheet feeding destination.

4. The apparatus according to claim 3, wherein the controller is configured to set at least one of the type and the content of the image to be formed for each page, when the print data include data for multiple pages.

5. The apparatus according to claim 3, wherein the content of the image is set as one of a black and white image and a color image, and a threshold value associated with the black and white image is less than a threshold value associated with the color image.

6. An image forming apparatus, comprising:

a first sheet storage;

a second sheet storage;

a sheet conveyer;

an image reading unit configured to read a surface of a sheet conveyed from the first sheet storage by the sheet conveyer;

an image forming unit configured to form an image on the sheet conveyed from the image reading unit by the sheet conveyer; and a controller configured to set at least one of the type and the content of the image to be formed, based on a user input designating said at least one of the type and the content of the image to be formed, determine an amount of a color material appearing on the surface of the sheet based on image data generated by the image reading unit, compare the determined amount of the color material and a threshold value, and determine the image forming unit as a sheet feeding destination when the determined amount of the color material is less than the threshold value, and the second sheet storage as the sheet feeding destination when the determined amount is greater than the threshold value, wherein the threshold value is associated with at least one of a type and content of an image to be formed on the sheet, and control the sheet conveyer to convey the sheet to the determined sheet feeding destination.

7. The apparatus according to claim 6, wherein the type of the image settable based on the user input include an internal-use image and an external-use image, and a threshold value associated with the internal-use image is less than a threshold value associated with the external-use image.

8. The apparatus according to claim 6, wherein the type of the image settable based on the user input include a confidential image and a non-confidential image, and a threshold value associated with the confidential image is greater than a threshold value associated with the non-confidential image.

9. A sheet sorting method carried out in an image forming apparatus including a first sheet storage, a second sheet storage, a sheet conveyer, an image reading unit, an image forming unit, and a controller, comprising:

conveying, by the sheet conveyer, a sheet stored in the first sheet storage;

reading, by the image reading unit, a surface of the sheet conveyed from the first sheet storage;

analyzing, by the controller, print data for an image to be formed on the sheet to set at least one of a type and a content of the image to be formed, wherein the content of the image is set as one of a text image and a picture image;

determining, by the controller, an amount of a color material appearing on the surface of the sheet based on image data generated by the reading;

comparing, by the controller, the determined amount of the color material and a threshold value;

determining, by the controller, the image forming unit as a sheet feeding destination when the determined amount of the color material is less than the threshold value, and the second sheet storage as the sheet feeding destination when the determined amount is greater than the threshold value, wherein the threshold value is associated with at least one of a type and content of an image to be formed on the sheet, and a threshold value associated with the text image is less than a threshold value associated with the picture image; and conveying, by the sheet conveyer, the sheet to the determined sheet feeding destination.

10. The method according to claim 9, wherein at least one of the type and the content of the image to be formed is set for each page, when the print data include data for multiple pages.

11. The method according to claim 9, wherein the type of the image is set as one of a confidential image and a non-confidential image, and a threshold value associated with the confidential image is greater than a threshold value associated with the non-confidential image.

* * * * *